US009179748B2

(12) United States Patent
Esti

(10) Patent No.: US 9,179,748 B2
(45) Date of Patent: Nov. 10, 2015

(54) APPARATUS FOR HOLDING ITEMS

(71) Applicant: BANDIT LLC., Reston, VA (US)

(72) Inventor: Robert Esti, Reston, VA (US)

(73) Assignee: BANDIT, LLC., Reston, VA (US)

( * ) Notice: Subject to any disclaimer, the term of this patent is extended or adjusted under 35 U.S.C. 154(b) by 28 days.

(21) Appl. No.: 14/156,964

(22) Filed: Jan. 16, 2014

(65) Prior Publication Data

US 2014/0196260 A1 Jul. 17, 2014

Related U.S. Application Data

(60) Provisional application No. 61/753,668, filed on Jan. 17, 2013.

(51) Int. Cl.
*A45C 1/06* (2006.01)
*A45C 13/30* (2006.01)

(52) U.S. Cl.
CPC . *A45C 1/06* (2013.01); *A45C 13/30* (2013.01); *A45C 2001/062* (2013.01); *A45C 2001/065* (2013.01); *Y10T 24/44* (2015.01); *Y10T 24/47* (2015.01)

(58) Field of Classification Search
CPC ..... A45C 1/06; A45C 2001/062; A45C 2001/065; A45C 13/30; Y10T 24/44; Y10T 24/1459; Y10T 24/4745; Y10T 24/4736; Y10T 24/4709; Y10T 24/47; Y10T 24/49; Y10T 24/492; Y10T 24/497
See application file for complete search history.

(56) References Cited

U.S. PATENT DOCUMENTS

| | | | | |
|---|---|---|---|---|
| 4,113,157 | A * | 9/1978 | Woodbury | 224/163 |
| 5,077,869 | A * | 1/1992 | Haase | 24/336 |
| 5,115,909 | A * | 5/1992 | Hull et al. | 206/38 |
| 5,249,437 | A * | 10/1993 | Cole, Jr. | 63/1.12 |
| 5,275,217 | A * | 1/1994 | Eakin | 150/132 |
| 5,427,233 | A * | 6/1995 | Zinck et al. | 206/69 |
| 6,134,753 | A * | 10/2000 | O'Mahony | 24/3.3 |
| 6,357,084 | B1 * | 3/2002 | Haidon | 24/3.12 |
| 6,708,375 | B1 * | 3/2004 | Johnson | 24/17 A |
| 6,745,805 | B2 * | 6/2004 | Thomson | 150/137 |
| 7,748,086 | B2 * | 7/2010 | Bridgefarmer | 24/17 B |
| 7,797,800 | B2 * | 9/2010 | Beltramello | 24/170 |
| 8,291,554 | B2 * | 10/2012 | Duer | 24/559 |
| 2005/0035005 | A1 | 2/2005 | Thomas | |
| 2009/0188956 | A1 | 7/2009 | Engaldo | |
| 2010/0205783 | A1 | 8/2010 | Bridgefarmer | |

* cited by examiner

*Primary Examiner* — Robert J Sandy
*Assistant Examiner* — Louis Mercado
(74) *Attorney, Agent, or Firm* — Andrew M. Calderon; Roberts Mlotkowski Safran & Cole, P.C.

(57) ABSTRACT

An apparatus for holding items, and more specifically an elastic band and clip apparatus is disclosed. The apparatus for holding items includes a band and a clip. The clip includes: a recessed portion provided in a facing surface of the clip which is structured to accommodate a medallion; fixing structures to fix the band to the clip; and a locking mechanism which is structured to lock portions of the clip together.

19 Claims, 16 Drawing Sheets

APPARATUS FOR HOLDING ITEMS

FIELD OF THE INVENTION

The present invention relates generally to an apparatus for holding items, and more specifically to an elastic band and clip apparatus.

BACKGROUND

Conventional methods of holding money and credit cards include a wallet or a money clip, as examples. The wallet can be bulky and cumbersome; whereas, money clips do not securely hold credit cards or other items. What is thus needed is a means of holding money and credit cards and other items in a secure manner.

SUMMARY OF INVENTION

In aspects of the invention, an apparatus for holding items comprises a band and a clip. The clip comprises: a recessed portion provided in a facing surface of the clip which is structured to accommodate a medallion; fixing structures to fix the band to the clip; and a locking mechanism which is structured to lock portions of the clip together.

In additional aspects of the invention, a clip comprises a stretchable band and a body portion. The body portion comprises: a recessed portion provided in a facing surface which is structured to accommodate and match a shape of a medallion; fixing structures comprising corresponding projections and openings to fix the band to the body, wherein the projections engage within the openings and the band is interposed between the corresponding projections and openings; and a locking mechanism comprising openings and outwardly extending projections, structured to lock portions of the body portion together.

BRIEF DESCRIPTION OF THE DRAWINGS

The present invention is described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice. The present invention is described in the detailed description which follows, in reference to the noted plurality of drawings by way of non-limiting examples of exemplary embodiments of the present invention.

The present invention relates generally to an apparatus for holding items, and more specifically to an elastic band and clip apparatus. In embodiments of the invention, the elastic band and clip apparatus can be used to hold money, credit cards, business cards, keys, etc. In embodiments, the elastic band and clip apparatus can be customized to include a patch, token, coin, medallion, etc. (hereinafter referred generally as a medallion) of any appropriate shape, size and design.

Figure 1:
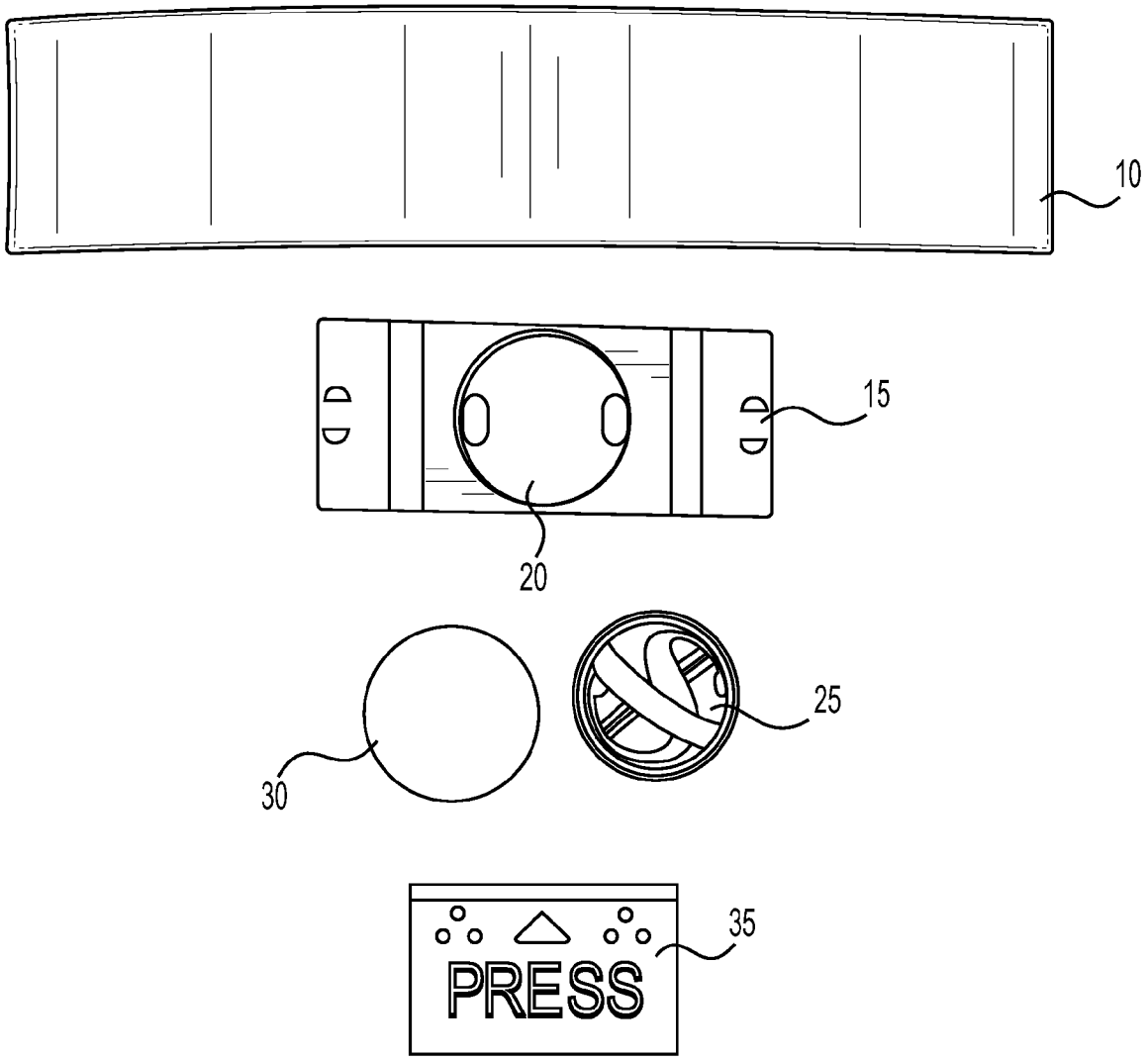
FIG. 1 shows multiple components of the elastic band and clip apparatus according to aspects of the invention.

FIG. 1 shows multiple components of the elastic band and clip apparatus according to aspects of the invention. More specifically, the components include a band 10 (e.g., strip of material), a clip 15, a medallion 25 and adhesive or hook and loop configuration 30 (where the hook side can be adhered to the clip 15 and the loop side can be adhered to the medallion 25 or vice versa); although other fastening mechanisms are also contemplated by the present invention as represented by reference numeral 30, e.g., magnet with an adhesive attaching to the clip 15. A press fit device 35 can be used in the assembly of the components. In embodiments, the band 10 can be an elastomeric material such as, for example, any elastomeric fabric, whether woven or unwoven. In further embodiments, other elastomeric materials are contemplated by the present invention such as, for example, rubber or other natural or synthetic materials that can stretch. In embodiments, the elastomeric material is stretchable, in order to securely retain an item when folded over as a band.

The clip 15 can be a plastic material such as, for example, polypropylene; although other materials are also contemplated by the present invention. The clip 15 includes a recessed portion 20, which corresponds in shape to the medallion 25. For example, the recessed portion 20 can be circular, oval, square or other shape which matches the shape of the medallion 25. In embodiments, the medallion 25 will be fitted into the recessed portion 20. The recessed portion 20 is thus provided on a facing surface of the clip which is structured to accommodate the medallion 25.

The medallion 25 can be retained in the recessed portion 20 by friction or adhesive, such as the adhesive tape or other fastening device(s) 30 shown in FIG. 1. It should be understood that the adhesive tape or other fastening device(s) 30 can be double sided tape, in order to adhere to both the backside of the medallion 25 and the surface of the recessed portion 20 of the clip 15. In embodiments, the adhesive tape or other fastening device(s) 30 can be the same size or smaller in size than the recessed portion 20 and/or medallion 25. Also, it should be understood by those of ordinary skill in the art that glue, adhesive or other mechanisms can be used to retain the medallion 25 within the recessed portion 20.

Figure 2:
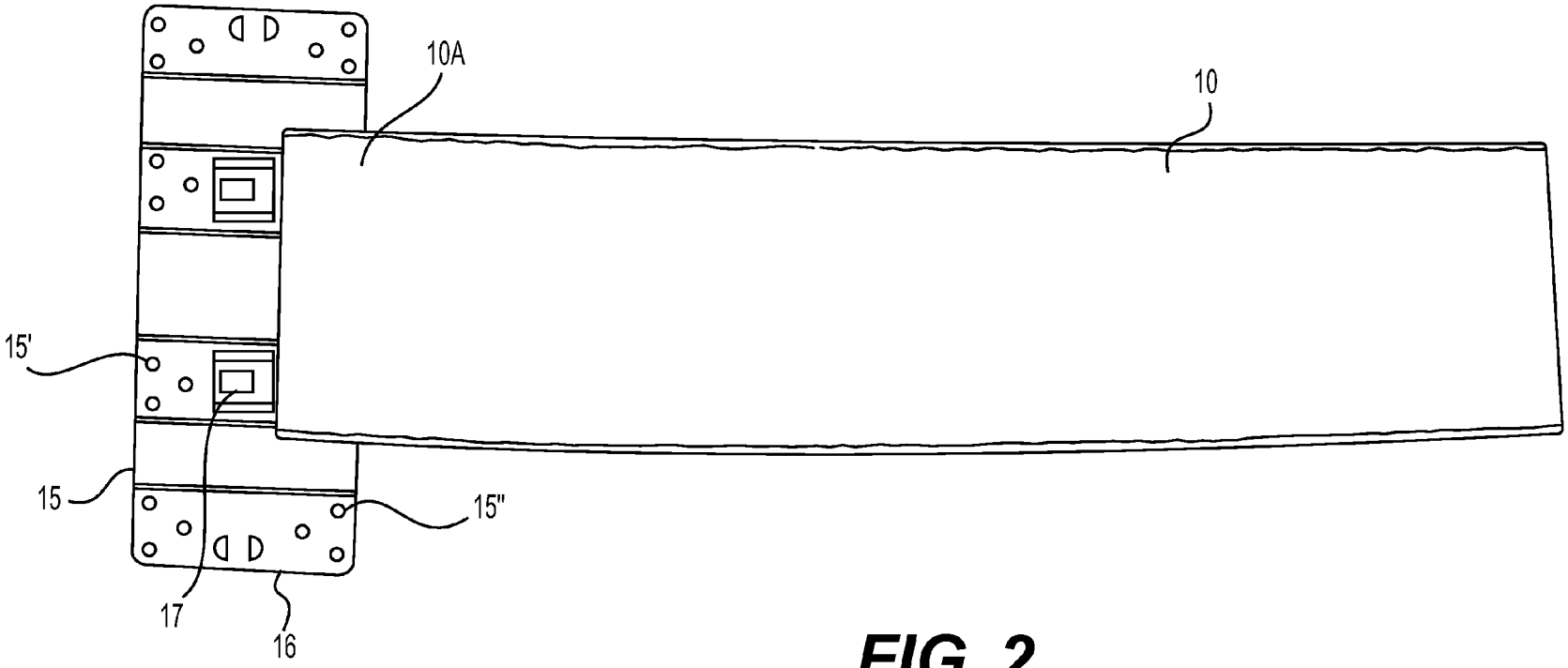
FIGS. 2-11 show various assembly stages of the components of FIG. 1, according to aspects of the invention.

FIGS. 2-11 show various assembly stages of the components of FIG. 1, according to aspects of the invention. More specifically, FIG. 2 shows a first end **10*a* of the band 10 connected or fixed to the clip 15. In embodiments, the band 10 can be fixed to the clip 15 using barbs or other types of projections 15' projecting from a backside surface of the clip 15. The clip 15 also includes corresponding openings 15" (aligned with the barbs or other types of projections 15', when the clip 15** is folded in a manner discussed below).

The clip 15 also includes a locking mechanism shown at reference numerals 16 and 17. More specifically, the locking mechanism includes outwardly extending projections 16, which can be fitted into a corresponding opening 17. In embodiments, the openings 17 can have a sliding surface (e.g., slanted surface) which facilitates the outwardly extending projections 16 being fitted within the opening 17. In embodiments, the outwardly extending projections 16 are resilient, such that they can be squeezed or forced together in order to fit within the opening 17. Once fitted with the opening 17, the outwardly extending projections 16 will lock within the opening 17, as should be understood by those of skill in the art.

Figure 3:
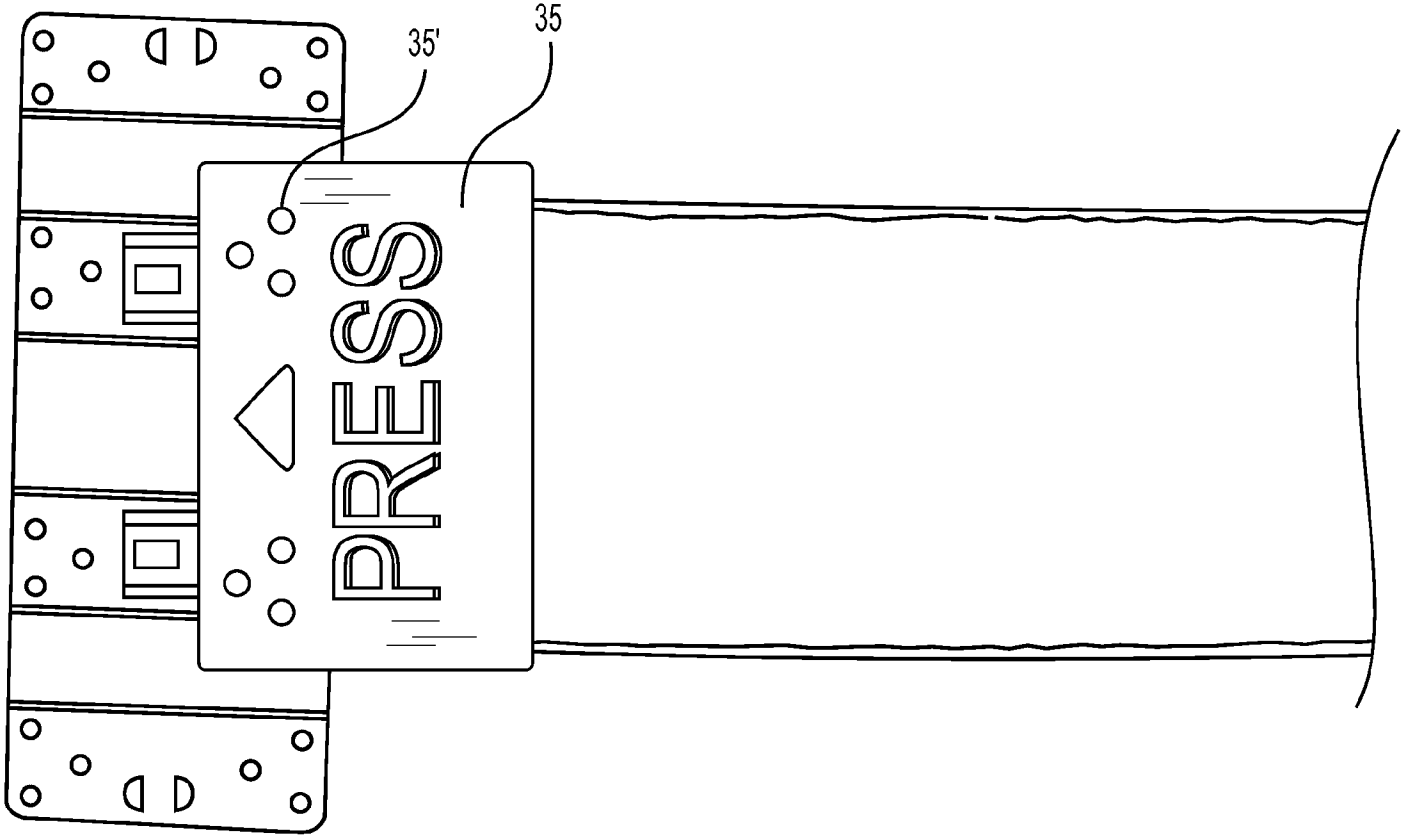
Figure 4:
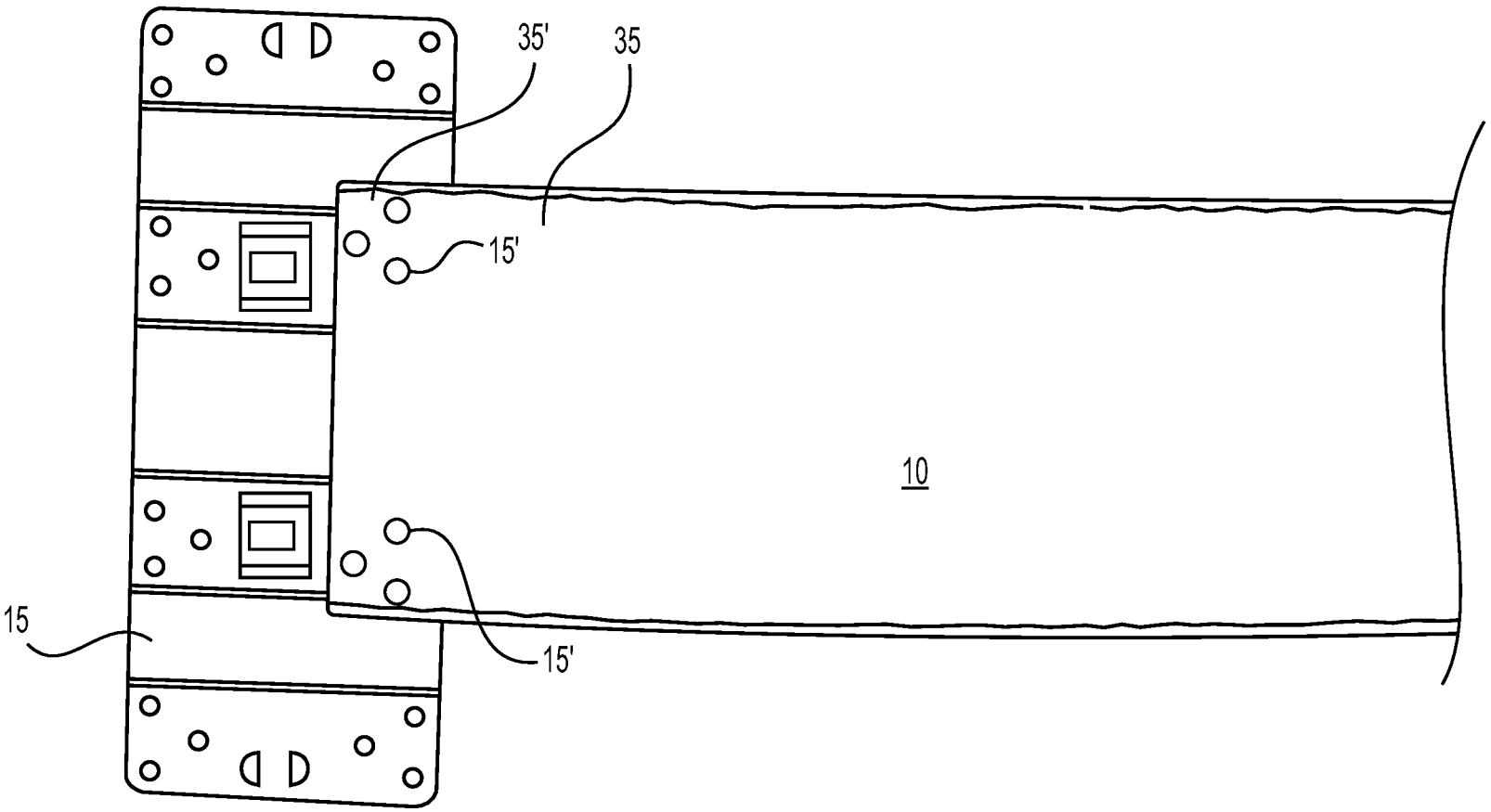

In FIG. 3, the end of the band 10 is pressed onto the barbs or other types of projections 15' projecting from a backside surface of the clip 15. This can be done by using the press fit device 35. Specifically, the press fit device 35 can be aligned over the end of the band 10, such that alignment holes (openings) of the press fit device 35 are aligned or substantially aligned with the barbs or other types of projections 15'. By placing a force on the press fit device 35, the barbs or other types of projections 15' will extend completely (or partially) through the band 10, fixing the band 10 to the clip 15. FIG. 4 shows the barbs or other types of projections 15' will extend completely through the band 10 (which are then later engaged within corresponding openings of the clip).

Figure 5:
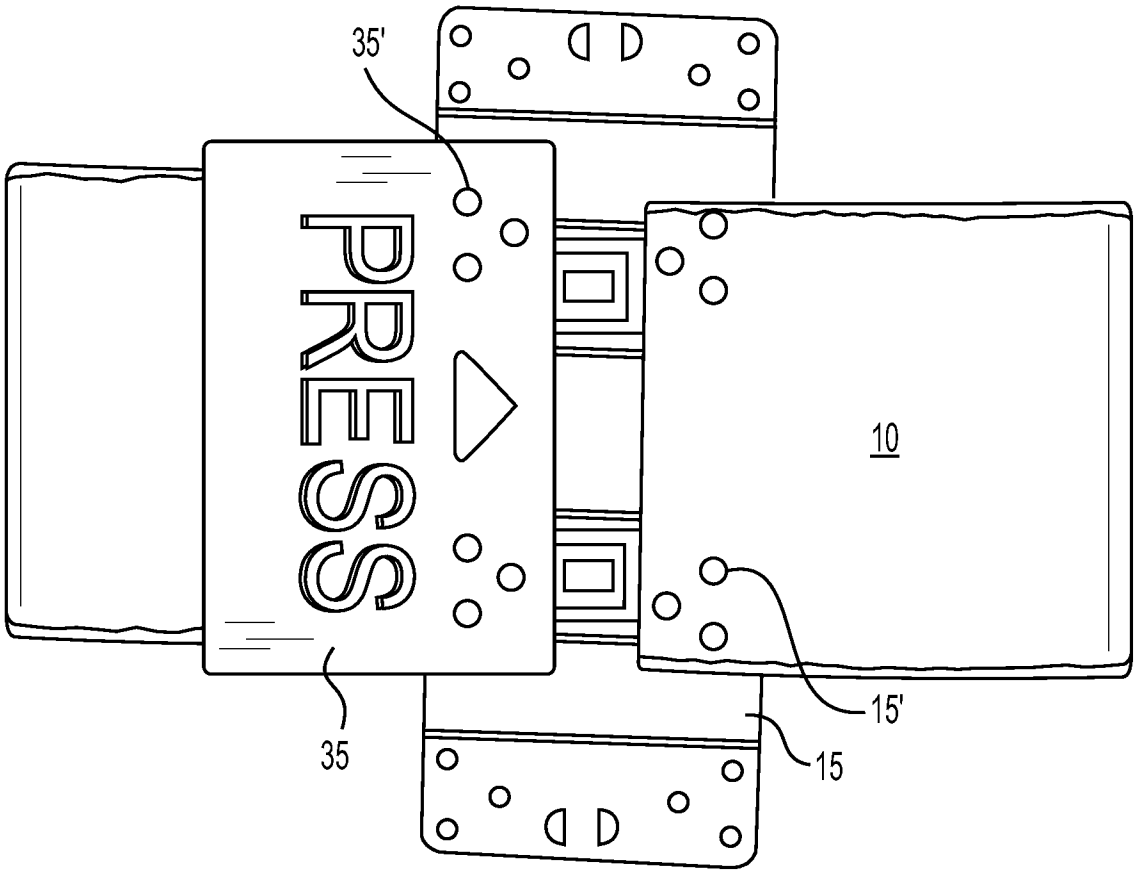
Figure 6:
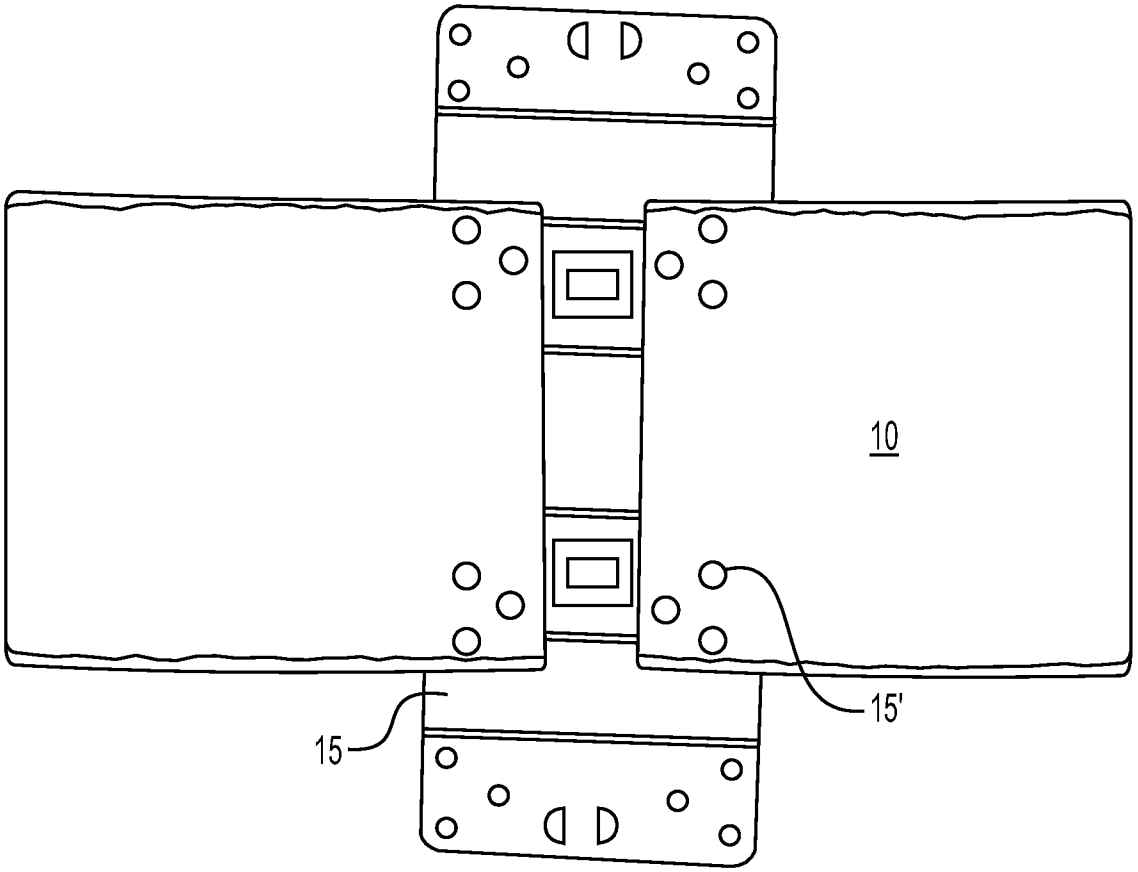

FIG. 5 shows a similar process as shown in FIGS. 3 and 4, but using the other end of the band 10. Specifically, the other end of the band 10 is pressed onto the barbs or other types of projections 15' projecting from a backside surface of the clip 15. This can be done by using the press fit device 35, as discussed above with regard to FIGS. 3 and 4. By placing a force on the press fit device 35, the barbs or other types of projections 15' will extend completely through the band 10, fixing the other end of the band 10 to the clip 15, as shown in FIG. 6. This results in a closed loop comprising the band 10 and the clip 15, which can be used to securely hold items such as, for example, paper money, credit cards, etc.

Figure 7:
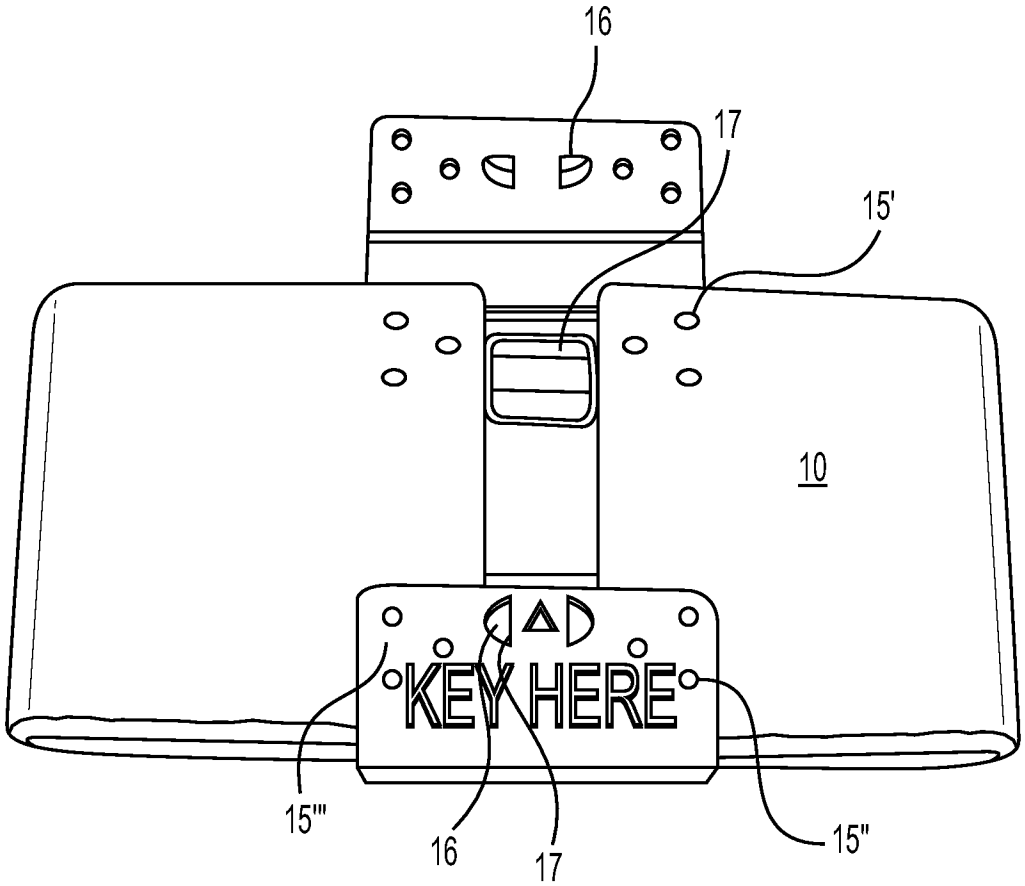

In FIG. 7, a hinged portion 15"' of the clip 15 is folded such that it now extends directly over the two ends of the band 10. By making such fold, the openings 15" are now aligned with the barbs or other types of projections 15', over both ends of the band 10 (on one side edge). Also, the outwardly extending projections 16 are aligned with the opening 17 such that, upon an application of force, the outwardly extending projections 16 will lock within the opening 17. In this way, at least one side of the band 10 is fixed to the clip 15.

Figure 8:
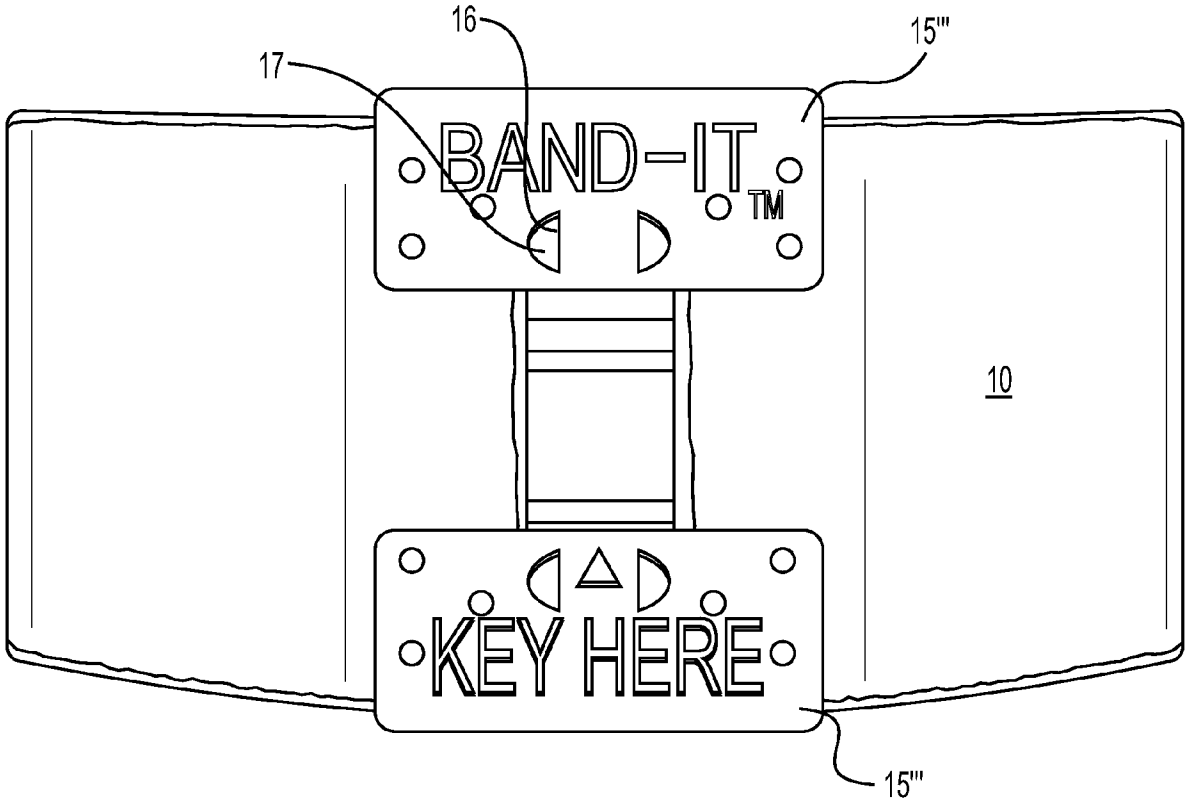

In FIG. 8, another portion 15"' of the clip 15 is folded such that it now extends directly over the two ends of the band 10, on an opposite side edge (compared to that shown in FIG. 7). By making such fold, the openings 15" are now aligned with the barbs or other types of projections 15', over both ends of the band 10 (on the other side edge). Also, the outwardly extending projections 16 are aligned with the opening 17 such that, upon an application of force, the outwardly extending projections 16 will lock within the opening 17. In this way, the other side of the band 10 is fixed to the clip 15.

Figure 9:
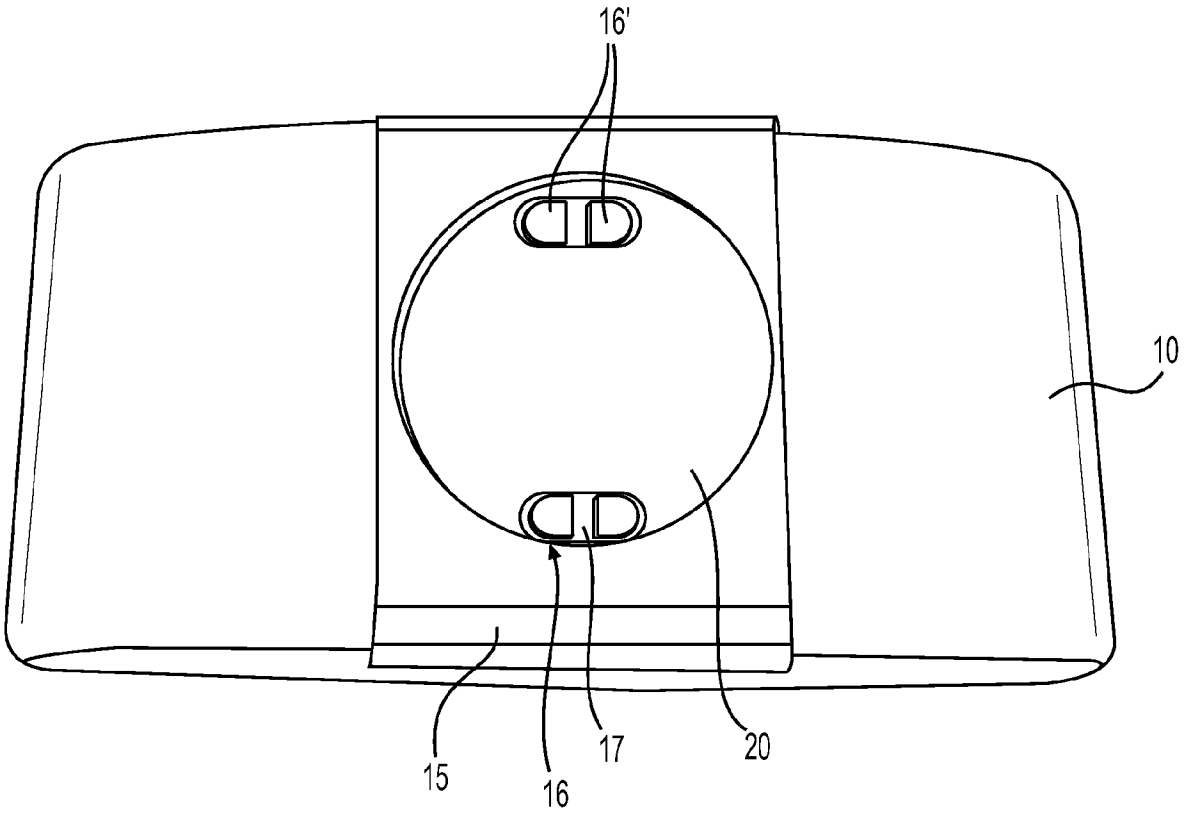

FIG. 9 shows a top side of the assembled band and clip assembly. As seen in this view, the outwardly extending projections 16 are locked within the opening 17, both of which are aligned within or correspond to the recessed portion 20. This view also shows that each of the outwardly extending projections 16' comprising two resilient, flexible snap closure projections that engage within the opening 17; although, other locking mechanisms are also contemplated by the present invention.

Figure 10:
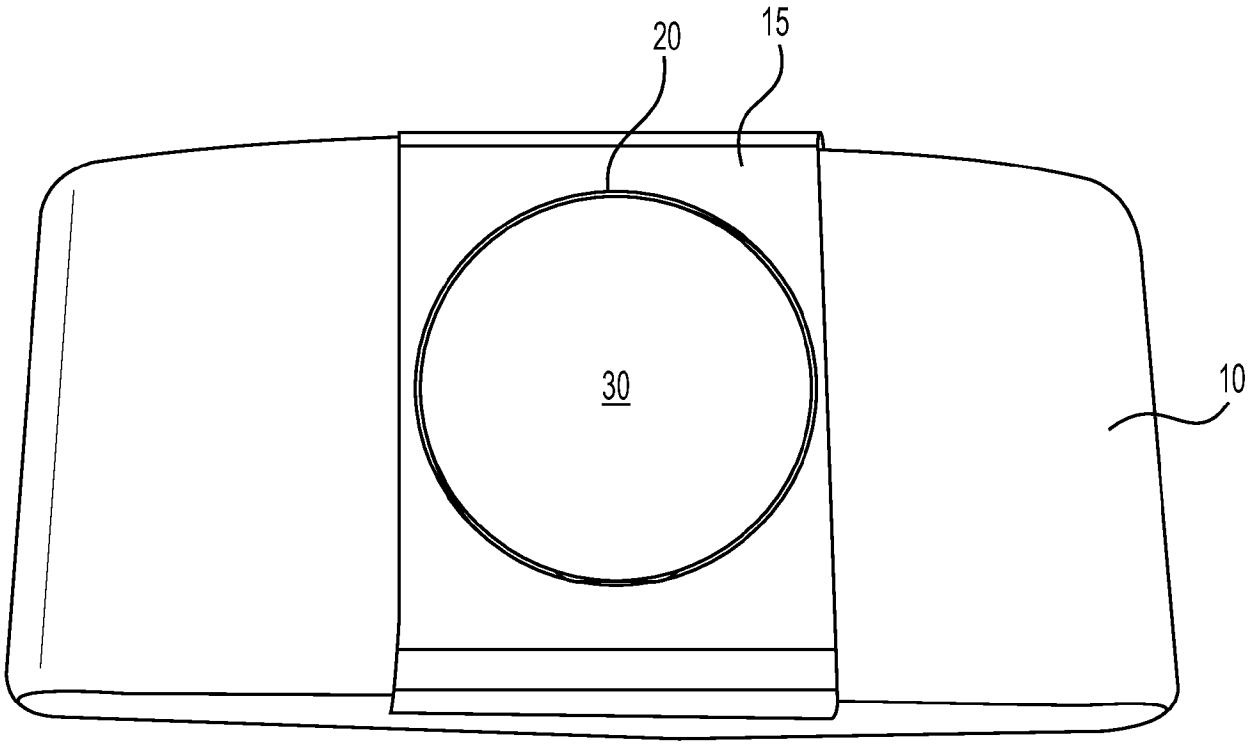
Figure 11:
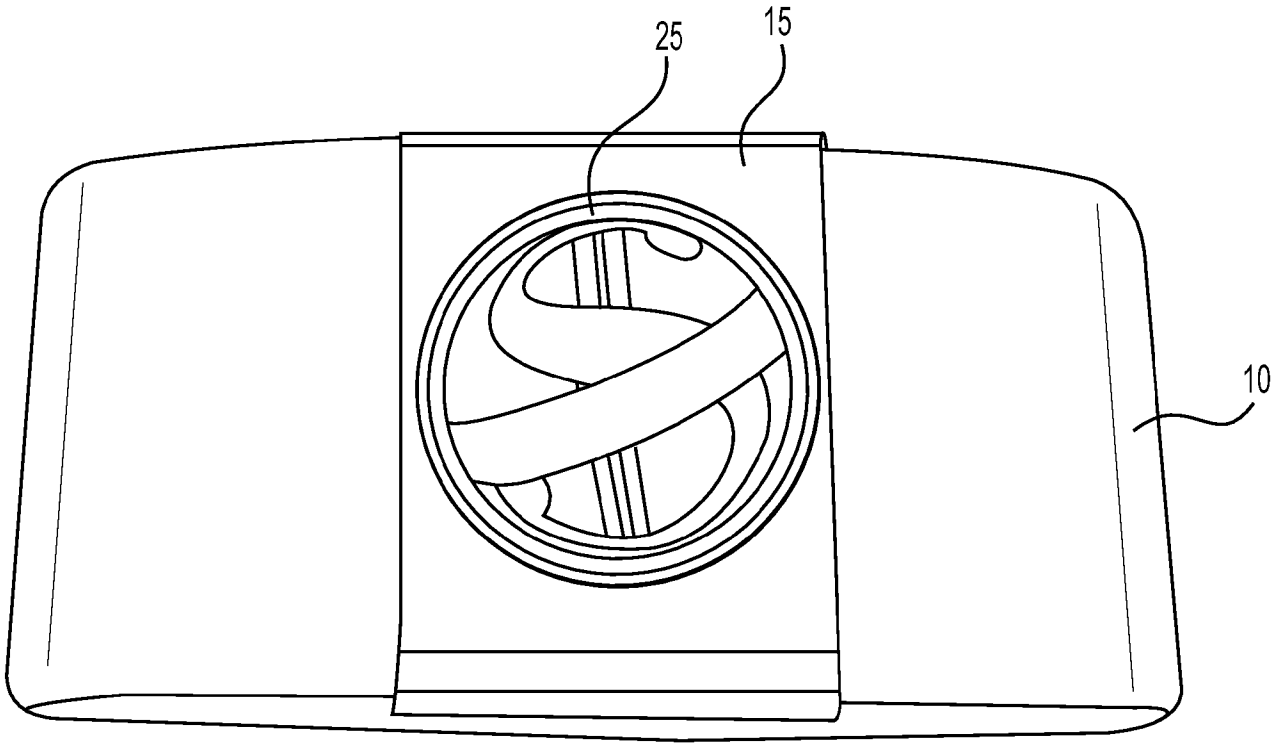

FIG. 10 shows the adhesive tape or other fastening device (s) 30 placed within the recessed portion 20 of the clip 15. FIG. 11 shows the medallion 25 fitted within the recessed portion 20. In this embodiment, the medallion is attached to the clip 15, on a surface of the recessed portion 20, by the adhesive tape 30; although, other attachment mechanisms are contemplated by the present invention.

Figure 12:
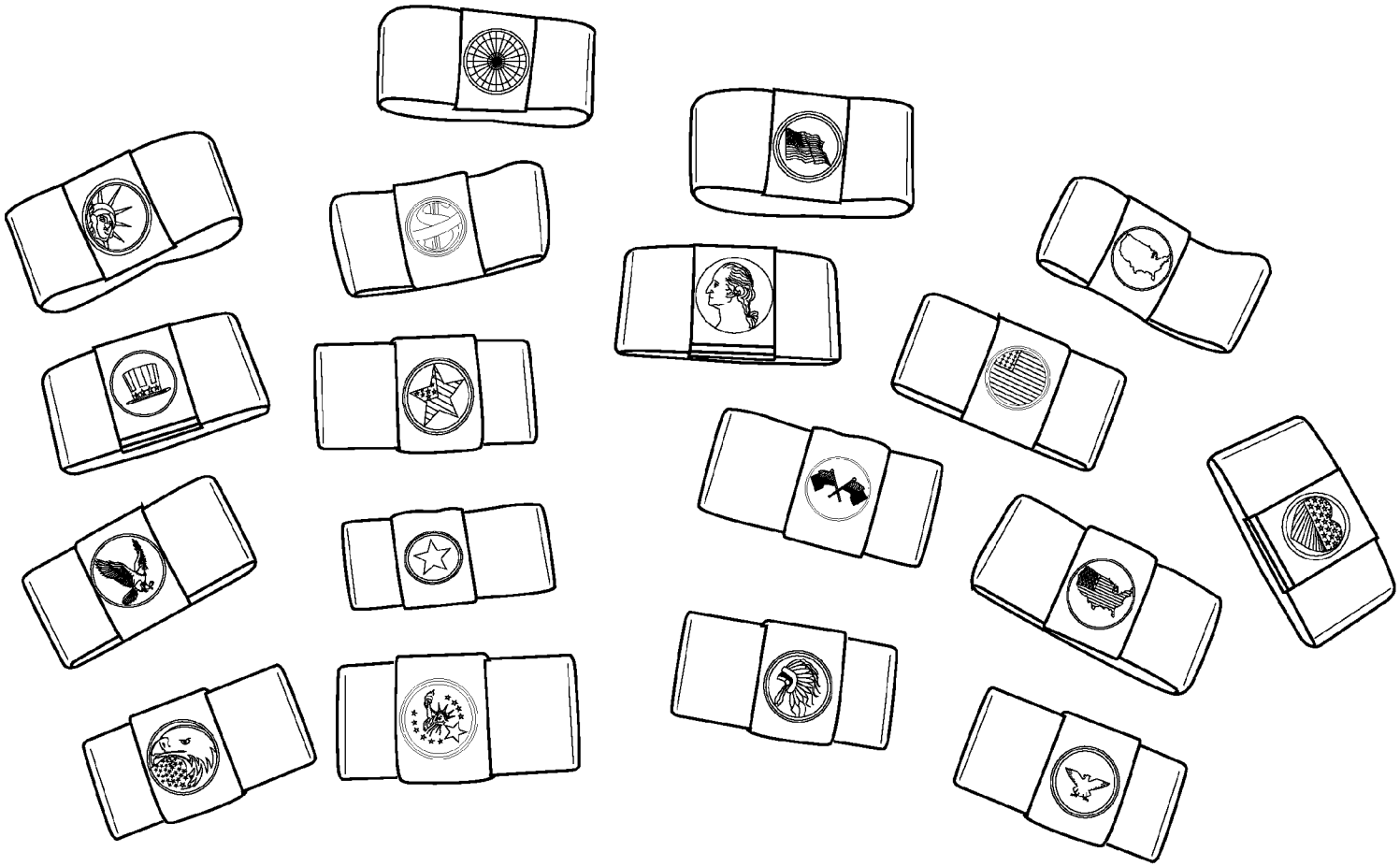
FIG. 12 shows various different embodiments according to aspects of the invention.

FIG. 12 shows various different embodiments according to aspects of the invention. More specifically, FIG. 12 shows the use of medallions with different designs.

Figure 13:
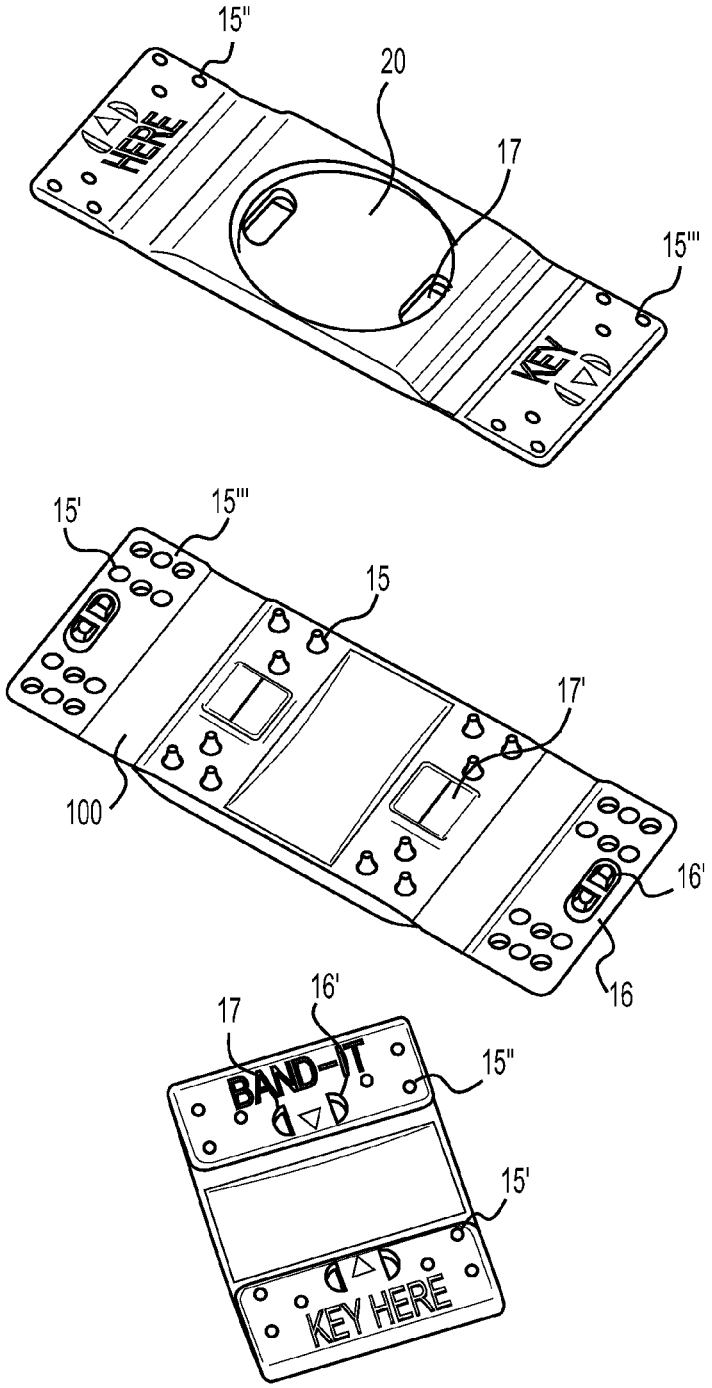
FIGS. 13-15 show different views of the clip according to aspects of the invention.
Figure 14:
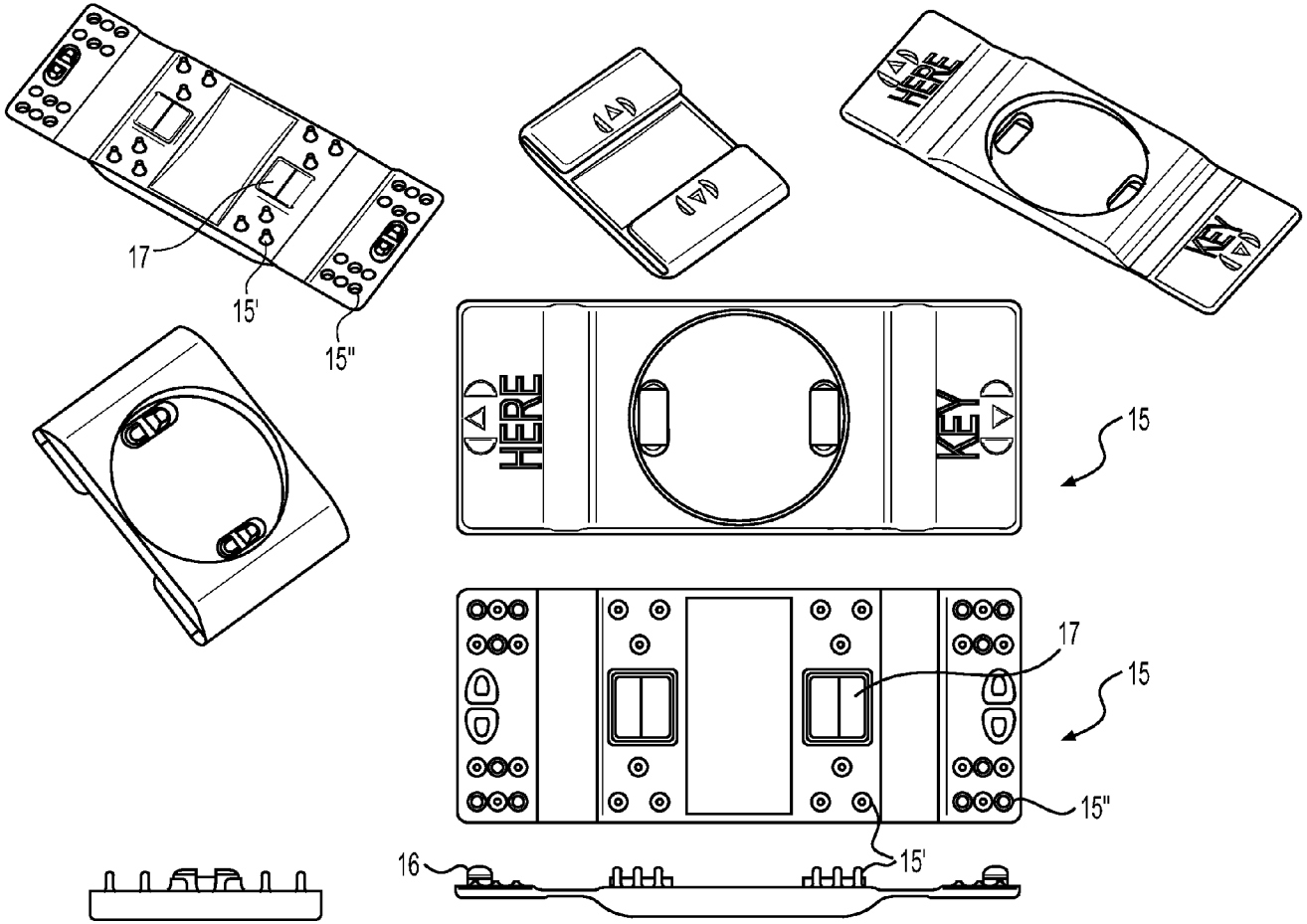
Figure 15:
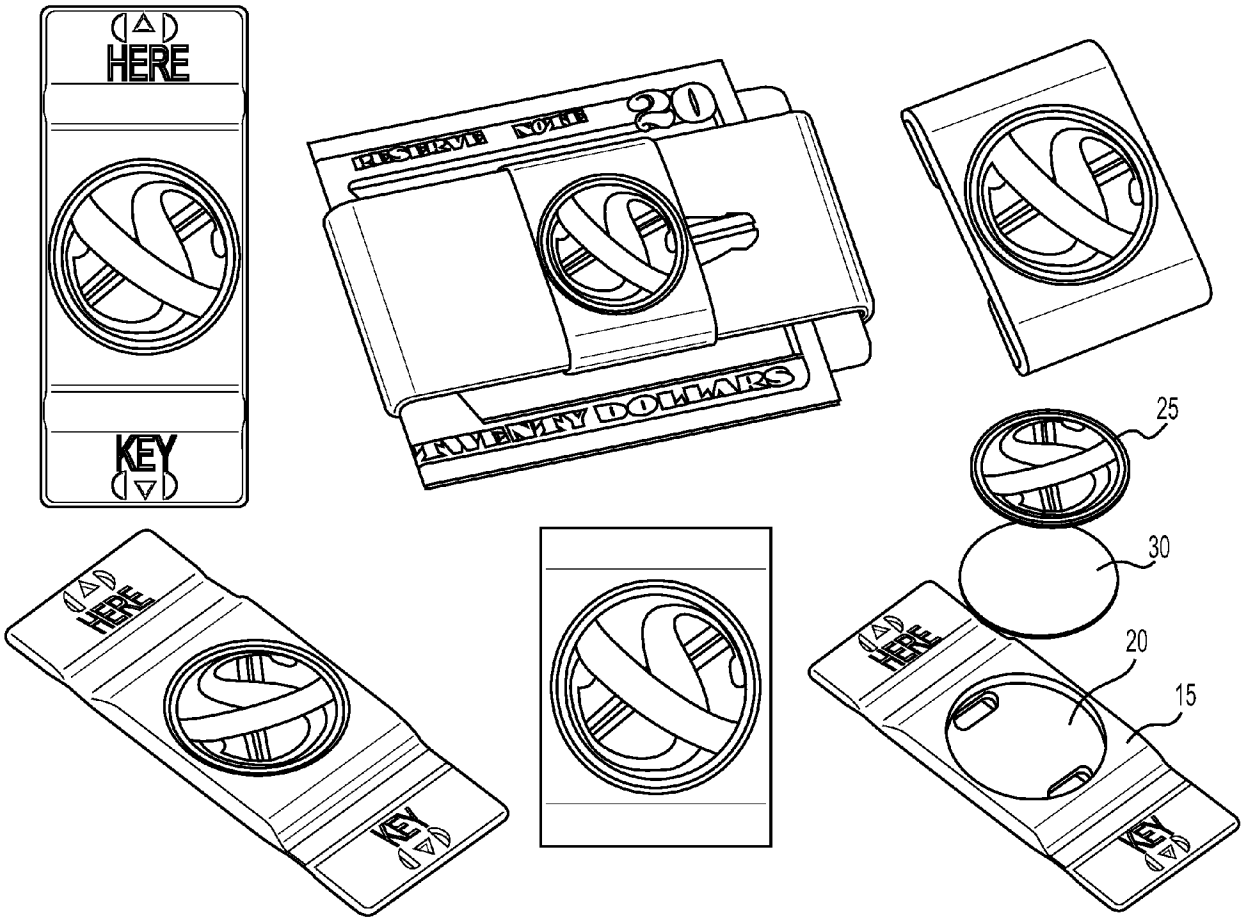

FIGS. 13-15 show different views of the clip according to several aspects of the invention. For example, FIG. 13 shows a front isometric view of the clip 15, a rear isometric view of the clip 15, and a rear isometric view with the clip 15 in the assembled state. As shown in FIG. 13, the openings 17 are aligned or correspond to the recessed portion 20. Also, the openings 15" and barbs or other types of projections 15' can be staggered in any pattern. In embodiments, six openings 15" and barbs or other types of projections 15' are provided on each side of the clip 15; although any number of such components is also contemplated by the present invention. For example, two or more openings 15" and corresponding barbs or other types of projections 15' can be provided on each side of the clip 15.

FIG. 13 also shows the sliding surface 17' of the opening 17, as well as the plastic flexible snap closure projections 16' used for the locking mechanism. Additionally, a hinge 100 is shown between a main (body) portion of the clip 15 and each of the hinged portions 15"'. In embodiments, the hinge 100 can be of a thinner material thickness than remaining portions of the main body, in order to accommodate the folding of the hinged portions 15"' as shown in FIG. 13.

FIG. 14 shows many exemplary dimensions of the components of the clip. It should be understood that the exemplary dimensions and materials shown in FIG. 14 are for illustrative purposes, and that these exemplary dimensions and materials should not be considered a limiting feature of the present invention.

FIG. 15 shows various components of the present invention, singularly, in an exploded view, and in an assembled state. In the assembled state, the clip assembly can accommodate a key or other object, etc. between the clip 15 and band 10 as shown at reference numeral 105. Also, the clip assembly can be used to hold money, credit cards as well as a host of other items, none of which should be considered a limiting feature of the claimed invention.

Figure 16:
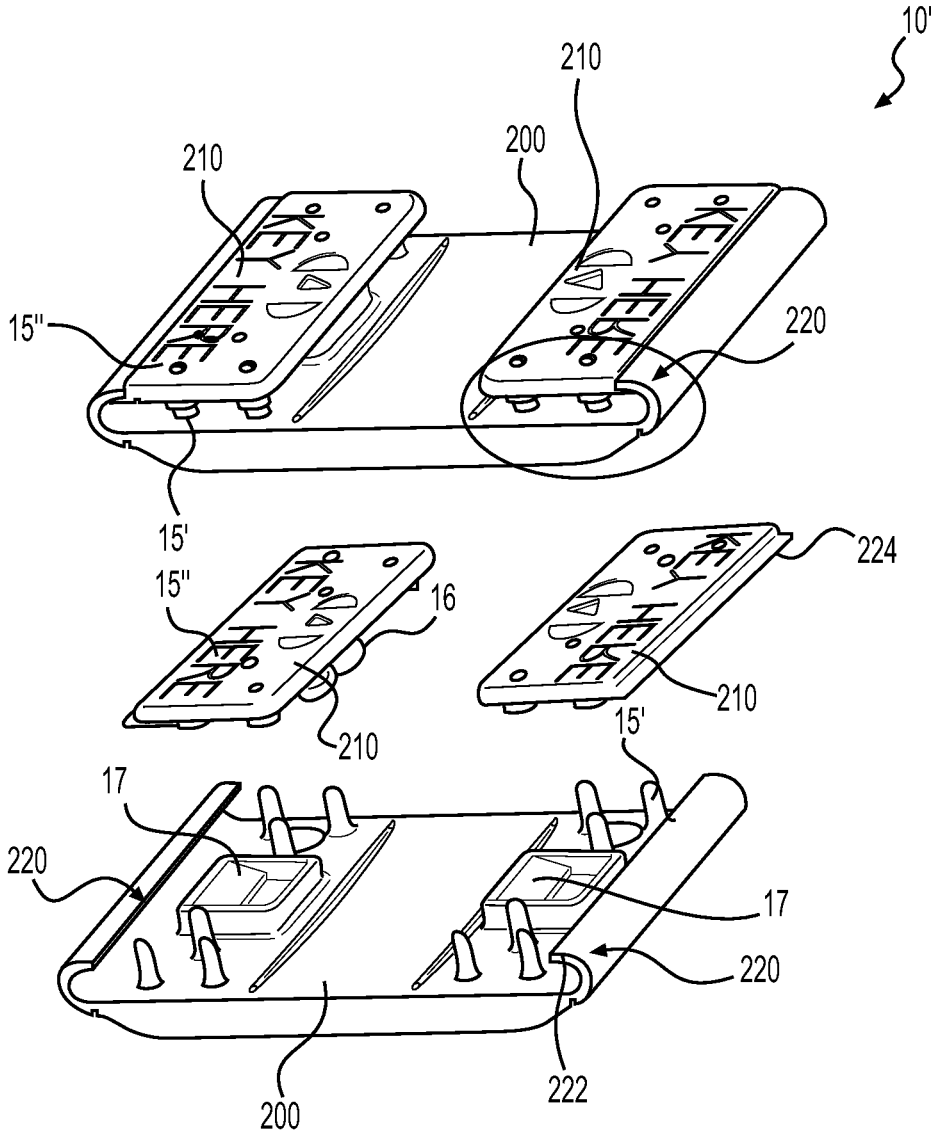
FIG. 16 shows another aspect of the present invention, in which the clip is provided as a three piece set.

FIG. 16 shows another aspect of the present invention, in which the clip 10' is provided as a three piece clamp set. In this embodiment, the clip 10' includes a base (main) portion 200 and two separate lid portions 210. As in the previous aspects of the present invention, the base portion 200 includes the barbs or other types of projections 15'; whereas, the lid portions 210 include corresponding openings 15" (aligned with the barbs or other types of projections 15'). The clip 10' further includes the locking mechanism, e.g., outwardly extending projections 16, which can be fitted into a corresponding opening 17 within the base portion 200. In embodiments, the openings 17 can have a sliding surface (e.g., slanted surface) which facilitates the outwardly extending projections 16 being fitted within the opening 17. The base portion 200 further includes a transitional area 220 with a smooth radius, e.g., semi-circular portion, which includes a lip portion 222. The separate lid portions 210 include a corresponding lip portion 224.

In the assembled state, the lip portion 224 of the separate lid portions 210 will engage underneath the respective lip portion 222 of the base portion 200. Also, the barbs or other types of projections 15' will engage with the corresponding openings 15" in order to lock the band to the assembled base portion 200 and lid portions 210, with the band engaged to the barbs or other types of projections 15'. In embodiments, the outwardly extending projections 16 are resilient, such that they can be squeezed or forced together in order to fit within the opening 17. As previously described, once fitted with the opening 17, the outwardly extending projections 16 will lock within the opening 17, as should be understood by those of skill in the art.

The foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. An apparatus for holding items, comprising:
a band; and
a clip comprising:
a recessed portion provided in a facing surface of the clip which is structured to accommodate a medallion;
first and second hinged portions provided at opposite sides of the clip, wherein the first and second hinged portions fold over the band;
fixing structures provided at each of the first and second hinged portions to fix a length of the band perpendicularly to the clip and retain the band in a loop; and
locking mechanisms provided at each of the first and second hinged portions structured to lock portions of the clip together,
wherein each of the locking mechanisms include outwardly extending projections, which are fittable into a single corresponding opening.

2. The apparatus of claim 1, further comprising the medallion, wherein the medallion is fixed within the recessed portion by adhesive.

3. The apparatus of claim 2, wherein the adhesive is double sided adhesive tape.

4. The apparatus of claim 1, wherein the band is woven or unwoven elastomeric fabric.

5. The apparatus of claim 1, wherein the clip is a plastic material.

6. The apparatus of claim 5, wherein the plastic material is polypropylene.

7. The apparatus of claim 1, further comprising the medallion, wherein the recessed portion matches a shape of the medallion.

8. The apparatus of claim 1, wherein the recessed portion is circular, oval or square.

9. The apparatus of claim 1, wherein the fixing structures comprise projections projecting from a surface of the clip and corresponding with openings in which the projections are fitted therein.

10. The apparatus of claim 9, wherein the projections are barbs fitted within the openings and which engage with the band.

11. The apparatus of claim 9, wherein the projections are provided on the first and second hinged portions of the clip, the first and second hinged portions being foldable.

12. The apparatus of claim 11, wherein the openings include a sliding surface which facilitates the projections being fitted within the openings.

13. The apparatus of claim 12, wherein the outwardly extending projections are resilient.

14. The apparatus of claim 13, wherein the outwardly extending projections are plastic flexible snap closure projections.

15. A clip, comprising:
a stretchable band; and
a body portion comprising:
a recessed portion provided in a facing surface which is structured to accommodate and match a shape of a medallion;
first and second hinged portions provided at opposite sides of the clip, wherein the first and second hinged portions fold over the band;
fixing structures provided at each of the first and second hinged portions and comprising corresponding projections and openings to fix a length of the band perpendicularly to the body and retain the band in a loop, wherein the projections engage within the openings and the band is interposed between the corresponding projections and openings; and
locking mechanisms provided at each of the first and second hinged portions, each of the locking mechanisms comprising openings and outwardly extending projections, structured to lock portions of the body portion together via a single opening.

16. The clip of claim 15, further comprising the medallion, wherein the medallion is fixed within the recessed portion by double sided adhesive tape.

17. The clip of claim 15, wherein the projections of the fixing structures are barbs which engage the band and are fitted within the corresponding openings.

18. The clip of claim 17, wherein the projections of the fixing structures are provided on the first and second hinged portions, the first and second hinged portions being foldable.

19. The clip of claim 15, wherein:
the openings of the locking mechanisms include a sliding surface which facilitates the outwardly extending projections being fitted within the openings; and
the outwardly extending projections are resilient and snap fittable within the openings.

* * * * *